United States Patent [19]

Adams et al.

[11] Patent Number: 4,889,145

[45] Date of Patent: Dec. 26, 1989

[54] SMOKING ROD WRAPPER AND COMPOSITIONS FOR THEIR PRODUCTION

[75] Inventors: Brian Adams, Newton Abbey; Linda Cunningham, Co. Armagh, both of Ireland

[73] Assignee: Gallagher Limited, England

[21] Appl. No.: 187,449

[22] PCT Filed: Aug. 27, 1987

[86] PCT No.: PCT/GB87/00604

§ 371 Date: Apr. 25, 1988

§ 102(e) Date: Apr. 25, 1988

[87] PCT Pub. No.: WO88/01478

PCT Pub. Date: Mar. 10, 1988

[30] Foreign Application Priority Data

Aug. 27, 1986 [GB] United Kingdom ..... 8620698
Jul. 6, 1987 [GB] United Kingdom ..... 8715849

[51] Int. Cl.[4] ..... A24D 1/02
[52] U.S. Cl. ..... 131/365
[58] Field of Search ..... 131/365, 358, 349, 352

[56] References Cited

U.S. PATENT DOCUMENTS

| | | |
|---|---|---|
| 2,992,647 | 7/1961 | Figge . |
| 3,511,247 | 5/1970 | Tamol . |
| 3,526,904 | 6/1970 | Tamol . |
| 3,699,973 | 10/1972 | Tamol et al. . |
| 3,911,932 | 10/1975 | Houck, Jr. et al. . |

FOREIGN PATENT DOCUMENTS

| | | |
|---|---|---|
| 0231664 | 8/1987 | European Pat. Off. . |
| 652124 | 10/1937 | Fed. Rep. of Germany . |
| 2362319 | 12/1974 | Fed. Rep. of Germany . |
| 1429778 | 6/1976 | United Kingdom . |
| 1439778 | 12/1978 | United Kingdom . |
| 2094611 | 9/1982 | United Kingdom . |

*Primary Examiner*—V. Millin
*Attorney, Agent, or Firm*—Andrus, Sceales, Starke & Sawall

[57] ABSTRACT

A wrapper for a smoking rod comprises a permeable substrate carrying a discontinuous coating of a porosity-reducing composition such that, in the coated area, the porosity of the wrapper is less than two thirds of the porosity of the uncoated substrate.

15 Claims, No Drawings

SMOKING ROD WRAPPER AND COMPOSITIONS FOR THEIR PRODUCTION

It is well known that the burn and smoke characteristics of a smoking rod are affected by the porosity of the rod wrapper. The wrapper typically has a porosity of, for instance, down to about 20 Coresta or up to, for instance, about 200 Coresta.

It is known to obtain special effects as a result of perforating certain regions of the wrapper, this perforation generally giving the wrapper a porosity above 1,000, for instance 5,000 to 7,000, Coresta. In order to defer the effect of these perforations it is known to block the perforations with a material that is intended to unblock the perforations as the burning tip approaches them. See for instance U.S. Pat. Nos. 2,992,647, 3,511,247 and 3,526,904 and GB 1,439,778. Although these compositions may be such as to permit the perforations to open as the burning tip approaches they do have the effect of rendering the wrapper, where there are no open perforations, substantially wholly impermeable.

The present invention relates primarily to unperforated wrappers, e.g., wrappers typically having porosity values below about 200 Coresta. With such unperforated wrappers it is known that reduced porosity can result in increased tar delivery, increased puff number and increased carbon monoxide delivery. The increased tar can be desirable as it gives an improved sensation to the smoker. The increased puff number tends to be undesirable as (unless the tar is increased sufficient to compensate) the smoke is likely to appear weak. Increased carbon monoxide is undesirable, particularly when the ratio of carbon monoxide:tar is increased.

In U.S. Pat. No. 3,911,932 a wrapper having an initial porosity of about 15 to 30 Coresta (60 to 20 seconds Greiner) is coated at the burning cone end with a film-forming, porosity-reducing additive to give a porosity of around 5 Coresta (120 to 300 second Greiner).

The material that is coated at the burning tip is applied as a continuous coating and the porosity-reduction due to this material will persist substantially up until the moment when the wrapper coated with the material is burnt.

It is also suggested in U.S. Pat. No. 3,911,932 that it can be desirable to have an intermediate zone of medium porosity between the low porosity cone end and the higher porosity mouth end, the intermediate zone having a porosity of 6 to 18 Coresta (120 to 60 seconds Greiner). It can be achieved by applying the porosity-reducing material in a solution that is sufficiently dilute that the solution forms a discontinuous film on the substrate whereas at the cone end a continuous film is formed, so as to give less porosity.

The purpose of reducing porosity near the burning tip is to increase the tar in the smoke. Unfortunately it also increases the carbon monoxide and, in particular, can increase the ratio of carbon monoxide to tar. The low porosity at the burning tip inhibits free burn (burn of the rod when air is not drawn through the rod by the smoker).

With conventional smoking rods, there is a tendency for the tar delivery in the later puffs to be considerably higher than in the earlier puffs. As a result the smoking sensation in the early puffs is relatively weak and if the total tar delivery is increased, so as to give stronger earlier puffs, this inevitably leads to an even higher tar delivery in the later puffs. It would be desirable to be able to alter the profile of the tar delivery, so that there is less difference between the early and late puffs, and to do this without having adverse effects on other smoking properties. It would also be desirable to be able to increase tar delivery without having an adverse effect on other smoking properties and, in particular, without increasing the ratio of carbon monoxide:tar and without significantly increasing the puff number of the smoking rod.

In the invention a smoking rod wrapper material comprises a permeable substrate having a coated area in which the material is coated or impregnated with a coating of porosity reducing porosity-reducing substance, and the material is characterised in that the coating is discontinuous and the porosity of the material in the coated area is (measured in coresta) less than two thirds the porosity of the uncoated substrate. Thus the porosity in coresta of the coated area is less than about 67% of the porosity in coresta of the substrate in the absence of the discontinuous coating or, expressed on an alternative basis, the porosity of the uncoated substrate is at least 50% greater than the porosity of the coated substrate.

Throughout this specification we refer to the substrate as being coated or uncoated and to the porosity reducing substance being present as a coating to form a coated area, but it should be understood that the porosity reducing substance may either be on the surface as a true coating or some or all of it may be impregnated into the substrate.

Generally the porosity in the coated area is below about 50% the porosity of the uncoated substrate. If the porosity in the coated area is too low then it is difficult to obtain the required balance of properties and so usually the porosity in the coated area is at least about 5 or 10%, and often at least about 20%, of the porosity of the uncoated substrate. Generally the porosity in the coated area is about 25 to about 50% of the porosity of the uncoated substrate, i.e. the uncoated substrate has a porosity 2 to 4 times the coated substrate. All these porosity values are measured in coresta.

Since the coating is discontinuous it consists of coated and uncoated regions within the coated area. The porosity of the substrate in the uncoated regions is higher than the porosity of the coated regions and the porosity in the uncoated regions is often close to or the same as the porosity of the initially uncoated permeable substrate.

The provision of uncoated regions in this manner within the coated area is desirable since it can permit sufficient ventilation through the coating, especially in the critical 10 mm, or possibly 20 mm, behind the burning cone to give beneficial free burn properties, and this greatly improves the overall smoking performance of the smoking rod.

If the size of the uncoated regions in the coated area is too small then they will give inadequate benefit, and for this reason the uncoated regions within the coated area should generally be at least 5%, and preferably at least 10%, and often at least 15%, of the coated area. If the regions are too large then the discontinuous coating will not reduce the permeability of the substrate sufficiently and the permeability of the coated substrate will, instead, be controlled primarily by the permeability of the uncoated regions. Accordingly the uncoated regions should normally cover less than 50%, generally less than 30% and most preferably less than 20%, of the coated area. Best results are generally obtained when the uncoated regions within the discontinuous coating cover around 10 or 15% to 20% of the area of that coating.

It is generally desirable that, within the coated area, the material should have substantially uniform properties and so generally the uncoated permeable substrate has substantially uniform porosity properties throughout its surface area and the uncoated regions are preferably distributed substantially uniformly throughout the coated area.

The discontinuous coating may be applied in any manner that permits the desired controlled porosity, but preferably it is applied by printing, preferably in a pattern. The printing pattern can be in any suitable form but is preferably in the form of dots that preferably have a diameter of from 0.3 to 3 mm, generally 0.5 to 2 mm and most preferably about lmm. The dots may be circular but are preferably substantially square. The separation between the dots is preferably from 0.03 to 0.3 mm, most preferably around 0.05 to 0.2 mm, with best results generally being obtained at around 0.mm.

Since the discontinuous coating reduces porosity it is desirable to include a burn promoter in the wrapper material so as to improve the balance of burn properties, and in particular so as to provide the material with a puff number that is not substantially greater than the puff number of the material if it was not provided with the coating.

Suitable burn promoters are well known and include alkali metal (generally sodium or potassium) salts of organic acid (generally citric acid or tataric acid), or potassium nitrate.

The burn promoter may be applied uniformly throughout the material, e.g., by impregnation into the wrapper in conventional manner. This is generally suitable when the coated area has a porosity of, for instance, above about 20 Coresta (and generally when the uncoated substrate has a porosity above about 80 Coresta) since adequate results can then be achieved with relatively low additions of burn promoter, typically 0.2 to 2%, generally about 1% (percentages are based on the weight of the substrate, which is typically about 40mg in a typical wrapper).

When the coated paper has a lower porosity (typically below 15 Coresta) and/or the uncoated paper has a porosity below 80 Coresta, larger amounts of burn promoting additive may be required to give adequate puff number, typically 2 to 10%, e.g., about 5%. These higher percentages can affect the taste and can increase tar delivery and so for these less porous wrappers it is particularly preferred to apply the burn promoter only in the coated area, and preferably to include it in the porosity-reducing composition. The amount of burn promoter may be from 5 to 50% generally 10 to 40% of the dry weight of the composition. It can be convenient to include the burn promoter in the discontinuous coating for all the wrapper materials of the invention.

Apart from the burn promoter, the porosity-reducing composition is preferably free of anything that will have significant organoleptic properties since the coating is generally present solely to alter the porosity and is not present primarily to provide an artificial additive to the smoke.

The porosity-reducing composition may be formed substantially only (e.g. above 80%, preferably above 90% dry weight) of a polymeric binder, and optionally burn promoter. Additives for adjusting rheology and other print characteristics may be included as necessary. The polymeric material may be a starch or cellulose polymer or derivative, for instance hydroxy-ethyl or -propyl cellulose, carboxy methyl cellulose or ethyl cellulose, or it may be a synthetic polymer, for instance polyvinyl alcohol or, preferably, ethylene vinyl acetate copolymer. Instead of using a polymeric binder, a material that will melt or volatilise during use, for instance as described in EP231664, can be used. Thus the composition can comprise 0 to 20% polymeric binder, optionally a burn promoter, and 80 to 100% of a non-polymeric material that melts or volatilises at 30 to 150%, preferably being a fatty acid salt or alcohol.

The permeable substrate is preferably an unperforated wrapper substrate of typical fibrous constitution and which has not been given any coating other than the discontinuous coating of the invention. However it may additionally be perforated and may have been given a continuous coating as described in EP231664, in which event the uncoated permeable substrate that is provided with a discontinuous coating in the invention is the coated, perforated, substrate of EP231664.

The discontinuous coating of the invention can extend along the entire length of the smoking rod but preferably extends only part way along the rod. Typically the coated area covers 40 to 80% of the total area of the wrapper (generally excluding any wrapper around a filter). The coated area may extend 40 or 50 to 95%, generally 50 to 85% and most preferably around 60 to 75%, of the length of the rod from the cone end towards the mouth end. For instance a typical rod having a burning length of about 75 mm may be coated for from about 30 to 65 cm, preferably 40 or 50 to 65 mm, generally about 60 mm, from the burning tip end. Alternatively the coated area can extend part way from the mouth end towards the cone. Generally it extends at least 5%, preferably at least 15% and most preferably at least 30%, of the distance from the mouth end towards the cone but generally less than 60% and preferably less than 50% of the distance. Typically the coating extends for at least 10 mm, and usually 20 to 50 mm, preferably 30 to 40 mm from the mouth end.

The total amount of coated porosity-reducing composition (dry weight) is generally below 1, and generally below 0.6 and often below 0.5, $mg/cm^2$ since such amounts are normally sufficient to achieve the desired low porosity values and it is unnecessary to add additional material. The amount is usually at least 0.1, and generally at least 0.2 $mg/cm^2$, since lower amounts may be inadequate to impart the desired porosity values. These amounts are considerably less than the rates of coating that have been used previously for printing active smoking ingredients on to wrappers, e.g., as described in GB 2,094,611. Despite the higher loadings, the distribution and size of the printed dots in GV 2094611 did not result in useful reduction of porosity.

The total loading of porosity reducing composition (dry weight) is generally below 4mg and preferably below 3.5mg. When it is applied at the burning tip end it is usually at least about 2 or 2.5mg but can be less, e.g., below lmg and as low as 0.7 or even down to 0.3mg, if it is applied at the mouth end.

Discontinuous coatings are generally applied by printing, preferably by gravure. The porosity-reducing material is generally applied as a dispersion or, preferably, as a solution in a solvent that is then evaporated. The solvent may be water or aqueous organic, generally alcoholic, solvent but is preferably a substantially non-aqueous alcohol or other organic solvent.

The invention includes also continuous sheets of wrapper material having uncoated areas and areas coated with a porosity-reducing substance all as described above, with the areas being arranged such that wrappers as defined above can be cut from the sheets. For instance there may be transverse or longitudinally arranged bands of coated material separated by bands of uncoated material, each type of band either being of the width for one wrapper or being of a width for two wrappers (arranged with two adjacent coated areas separated by two adjacent uncoated areas).

The following are some examples.

EXAMPLE 1

Three cigarette rod wrappers having initial porosities of 50, 80 and 135 Coresta respectively were printed by a composition of 30% ethylene vinyl acetate in ethanol to give a pattern of dots having a diameter of lmm covering 60% of the surface of the printed area which extended 65 mm from the cone end of the rod. The porosity, puff number, delivery of tar and delivery of carbon monoxide was recorded for each of the uncoated papers (control) and for the printed samples and the results are shown in Table 1.

TABLE 1

| | 50 Coresta | | 80 Coresta | | 135 Coresta | |
|---|---|---|---|---|---|---|
| | Control | Sample | Control | Sample | Control | Sample |
| Porosity (Coresta) | 47 | 15 | 78 | 20 | 118 | 46 |
| Puff No. | 10.0 | 10.3 | 10.3 | 10.8 | 10.5 | 11.1 |
| Tar mg | 10.2 | 12.31 | 10.0 | 12.25 | 9.9 | 10.89 |
| CO mg | 10.3 | 13.4 | 9.6 | 12.7 | 7.4 | 9.45 |

This clearly shows that the samples of the invention can give increases tar yield without significantly adversely effecting the tar: Co ratio.

EXAMPLE 2

Paper having a porosity of 135 Coresta impregnated with 1% (based on the weight of paper) sodium citrate was printed over an area of 12 $cm^2$ extending from the cone end (about 60% of the length of the rod) with square dots having a side length of lmm and a separation between the sides of 0.1 mm and formed of ethylene vinyl acetate copolymer in an appropriate carrier. The printed paper had a porosity of 30 Coresta.

The smoking performance of the sample wrapper according to the invention, carrying the discontinuous coating, and a control wrapper of the same substrate but without the discontinuous coating, was assessed. The puff number and the weight of tar in mg (total particulate matter) was recorded for the sample and for the control for each puff, and the percentage change in tar in each puff was recorded. The results are shown in table 2.

| PUFF NO. | SAMPLE TAR mg | CONTROL TAR mg | % CHANGE |
|---|---|---|---|
| 1 | 0.52 | 0.52 | 0 |
| 2 | 0.72 | 0.62 | +16 |
| 3 | 0.88 | 0.77 | +14 |
| 4 | 0.96 | 0.99 | −3 |
| 5 | 1.14 | 1.22 | −7 |
| 6 | 1.12 | 1.38 | −18 |
| 7 | 1.30 | 1.68 | −23 |

-continued

| PUFF NO. | SAMPLE TAR mg | CONTROL TAR mg | % CHANGE |
|---|---|---|---|
| 8 | 1.46 | 1.79 | −18 |
| 9 | 1.60 | 2.04 | −21 |
| 10 | 1.31 | 0.09 | — |

Thus by the invention it is seen that this particular construction of cigarette has permitted the tar delivery profile to be more uniform when using the printed wrapper of the invention than the unprinted control, with a relative increase in the tar delivery in the early puffs and relative decrease in the later puffs.

In the following examples this change in profile is indicated by the "tar ratio" which is the ratio of the amount of tar in the last full puff to the amount of tar in the first full puff. The ratio should be as low as possible.

EXAMPLE 3

The process of example 2 was repeated, using 0.15 to 0.3 mg/$cm^2$ ethylene vinyl acetate copolymer, but the paper had an initial porosity of 30 Coresta, a final porosity of 11 Coresta, and the dry components of the composition that was printed were a 2:1 by weight mixture of ethylene vinyl acetate copolymer with sodium acetate. The tar ratio was 1.7 for the sample and 2.2 for the control.

EXAMPLE 4

The process of example 2 was repeated except that the initial paper had a porosity of 30 Coresta, was impregnated with 3% by weight sodium citrate as burn promoter, and was printed with 0.2mg/cm: ethylene vinyl acetate copolymer to give a porosity in the coated area of 8 Coresta. The tar ratio was 1.8 for the sample and 2.2 for the control.

EXAMPLE 5

The process of example 2 was repeated except that the printed composition consisted primarily of palmitic acid salt as described in EP231664 and was printed in a pattern, as in example 2 but covering approximately half the length of the wrapper from the mouth end. The tar ratio was 1.9 for the sample and 2.2 for the control. Similar results were obtained using octadecanol in place of the fatty acid salt.

We claim:

1. A smoking rod wrapper material comprising a permeable substrate having an area containing a coating, said area containing a coating having a discontinuous coating of a porosity-reducing composition defining coated regions and uncoated regions throughout the entirely of said area, the portion of said area containing a coating occupied by said uncoated regions being between 5 and 50% of said area, and the porosity of the material in said area containing a coating (measured in coresta) being less than two thirds the porosity of said permeable substrate in the absence of the coating.

2. A material according to claim 1 in which the porosity of said area containing a coating (measured in coresta) is from 25 to 50% of the porosity of the permeable substrate in the absence of the coating.

3. A material according to claim 1 in which the area containing a coating has a porosity of 3 to 60 coresta and the porosity of the permeable substrate in the absence of the coating is between 20 to 200 coresta.

4. A material according to claim 1 wherein the area of said substrate containing a coating has a porosity below 40 coresta and in which the porosity of the permeable substrate in the absence of the coating is between 30 and 150 coresta.

5. A material according to claim 1 in which the area containing a coating occupies 40 to 80% of the area of the wrapper material.

6. A material according to claim 1 wherein the material has a burning tip end and a mouth end separated by a length corresponding to that of the smoking rod and in which the area containing a coating extends from the burning tip end a distance of from 40 to 85% of said length or extends from said mouth end by a distance of from 15 to 60% of said length.

7. A material according to claim 1 including 0.2 to 10%, by weight of the substrate, of a burn promoter.

8. A material according to claim 1 in which said area containing a coating has a porosity of at least 20 coresta and the material includes a burn promoter in said area containing a coating in an amount of 0.2 to 2%, based on the weight of the substrate.

9. A material according to claim 1 in which said area containing a coating has a porosity of below 5 coresta and said discontinuous coating includes a burn promoter in an amount of from 2 to 10% by weight of the substrate.

10. A material according to claim 1 in which said composition is substantially free of any organoleptic additive other than a burn promoter.

11. A material according to claim 1 in which the amount of said porosity-reducing composition is 0.2 to lmg per 2 of said area containing a coating.

12. A material according to claim 1 in which the said uncoated regions occupy 10 to 30% of the coated area.

13. A material according to claim 1 in which the porosity-reducing composition is selected from a class consisting of ethylene vinyl acetate, a fatty alcohol, and a fatty acid salt.

14. A material according to claim 1 in the form of a wrapper around a smoking rod.

15. A material according to claim 1 wherein the coated regions are further defined as regions of porosity-reducing composition that have been applied by printing said composition on said permeable substrate.

* * * * *